US006676452B2

(12) United States Patent
Bolen et al.

(10) Patent No.: US 6,676,452 B2
(45) Date of Patent: Jan. 13, 2004

(54) UNLOCK PROOF SQUIB CONNECTOR

(75) Inventors: Patrick A. Bolen, Carthage, IL (US); Qiyuan Liu, Macomb, IL (US)

(73) Assignee: Methode Electronics, Inc., Chicago, IL (US)

( * ) Notice: Subject to any disclaimer, the term of this patent is extended or adjusted under 35 U.S.C. 154(b) by 146 days.

(21) Appl. No.: 09/828,057

(22) Filed: Apr. 9, 2001

(65) Prior Publication Data

US 2002/0146942 A1 Oct. 10, 2002

(51) Int. Cl.[7] ..... H01R 13/415
(52) U.S. Cl. ..... 439/743
(58) Field of Search ..... 439/700, 743, 439/861, 353, 152, 159, 923, 292, 293, 295, 704

(56) References Cited

U.S. PATENT DOCUMENTS 4,526,431 A * 7/1985 Kasukawa ..... 439/153
5,178,552 A * 1/1993 Jinno et al. ..... 439/140
5,586,902 A * 12/1996 Hopf et al. ..... 439/352
5,613,865 A * 3/1997 Dullin et al. ..... 439/188
5,616,045 A * 4/1997 Gauker ..... 439/352
5,681,187 A * 10/1997 Fukushima et al. ..... 439/700
5,688,141 A * 11/1997 Dullin ..... 439/352
5,713,765 A * 2/1998 Nugent ..... 439/217
5,993,230 A * 11/1999 Gauker et al. ..... 439/188
6,022,239 A * 2/2000 Wright ..... 439/354
6,206,717 B1 * 3/2001 Matsumoto ..... 439/354
6,315,585 B1 * 11/2001 Oka ..... 439/157

* cited by examiner

*Primary Examiner*—Tulsidas Patel
(74) *Attorney, Agent, or Firm*—Seyfarth Shaw

(57) ABSTRACT

A squib connector is provided that allows detection of an improper connection within a squib connector prior to incorporation within an airbag mechanism. The squib connector includes a male squib connector and a female squib connector. Positioned within the female squib connector is a disengaging member. The disengaging member may be, for example, a spring or the like. The disengaging member prevents the male squib connector and female squib connector from having an electrical connection if the male squib connector and female squib connector are not properly interlocked. The disengaging member performs this function by forcing the male squib connector away from the female squib connector at such a distance that no electrical connection is possible. The improperly connected squib connector may then be more easily detected. Thus, the squib connector improves the efficiency and reliability of the airbag mechanism.

24 Claims, 2 Drawing Sheets

UNLOCK PROOF SQUIB CONNECTOR

BACKGROUND OF THE INVENTION

1. Field of the Invention

The present invention generally relates to an apparatus and a method that improves detection of a faulty connection within an airbag mechanism. More specifically, the present invention relates to a squib connector which allows a user to detect an improper connection between a male squib connector and a female squib connector.

2. Discussion of the Background

Airbag mechanisms in automobiles rely on a plurality of components for proper release of the airbag in emergency situations. Among these components are clocksprings and airbag igniters. Clocksprings and airbag igniters have an electrical connection by means of a squib connector.

A squib connector has a male squib connector and a female squib connector. The female squib connector is connected to an airbag canister. Typically, on an assembly line, the male squib connector is locked into a female squib connector by an operator who pushes the male squib connector into the female squib connector. Or, the male squib connector may be mechanically placed within the female squib connector. A defect in the squib connector can exist if the male squib connector has not been properly positioned within the female squib connector. However, there may be difficulty in locating the defect, based on the electrical connection that can still exist between the female squib connector and the male squib connector. The defective squib connector may still pass a test at the end of the assembly line for an electrical connection. However, the defect could eventually lead to airbag malfunction which may prove hazardous during emergency situations.

A need, therefore exists, to provide a squib connector with a mechanism to prevent faulty connections between the male squib connector and the female squib connector as the male squib connector and the female squib connector are interlocked on an assembly line. A further need exists to provide a more efficient and reliable airbag mechanism.

SUMMARY OF THE INVENTION

The present invention provides a squib connector that prevents defects in coupling between a male squib connector and a female squib connector. A disengaging member implemented within the female portion prevents the male squib connector and the female squib connector from closing a circuit if the male squib connector and the female squib connector are not properly interlocked. Thus, the improper connection may be detected by a test at the end of an assembly line. The improved squib connector can be incorporated in an airbag mechanism to provide increased reliability and efficiency.

To this end, in an embodiment of the present invention, a squib connector is provided. The squib connector includes a male squib connector. A female squib connector sized to receive at least a portion of the male squib connector is also provided. The female squib connector includes a disengaging member located within the female squib connector.

In another embodiment of the present invention, a female squib connector is provided. The female squib connector has a disengaging member positioned within the female squib connector for providing resistance against the placement of at least a portion of a male squib connector within the female squib connector.

In still another embodiment of the present invention, a method is provided for detecting an improper connection in a circuit. The method includes the steps of providing a male squib connector; providing a female squib connector sized to receive at least a portion of the male squib connector; and positioning a disengaging member within the female squib connector for providing resistance against placement of the portion of the male squib connector within the female squib connector.

In yet another embodiment, an airbag mechanism is provided. The airbag mechanism includes a squib connector. The squib connector includes a female squib connector and a male squib connector. The squib connector further includes a disengaging member positioned within the female squib connector for providing resistance against placement of a portion of the male squib connector within the female squib connector until the female squib connector and the male squib connector are interlocked.

It is, therefore, an advantage of the present invention to provide an improved squib connector which prevents an improper connection of a male squib connector and a female squib connector.

Another advantage of the present invention is to provide an improved squib connector that increases detection of improperly connected squib connectors.

A further advantage of the present invention is to provide an improved squib connector that reduces the cost of manufacturing airbag mechanisms.

Yet another advantage of the present invention is to provide an improved squib connector that reduces costs of detecting improperly connected male and female squib connectors.

A still further advantage of the present invention is to provide an improved airbag mechanism having increased efficiency.

Another advantage of the present invention is to provide an improved airbag mechanism having increased reliability.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PRESENTLY PREFERRED EMBODIMENTS

The present invention provides an improved squib connector implemented in an airbag mechanism that allows the user to detect a faulty connection between a male squib connector and a female squib connector. A disengaging member positioned within the female squib connector prevents an electrical connection between the male squib connector and the female squib connector until the male squib connector is interlocked with the female squib connector. If the male squib connector is not properly interlocked within the female squib connector, the faulty connection may be detected within the fault diagnostics of the vehicle airbag controller (i.e., an airbag annunciation light is illuminated). Thus, the improved squib connector increases the efficiency and reliability of the airbag mechanism.

Figure 1:
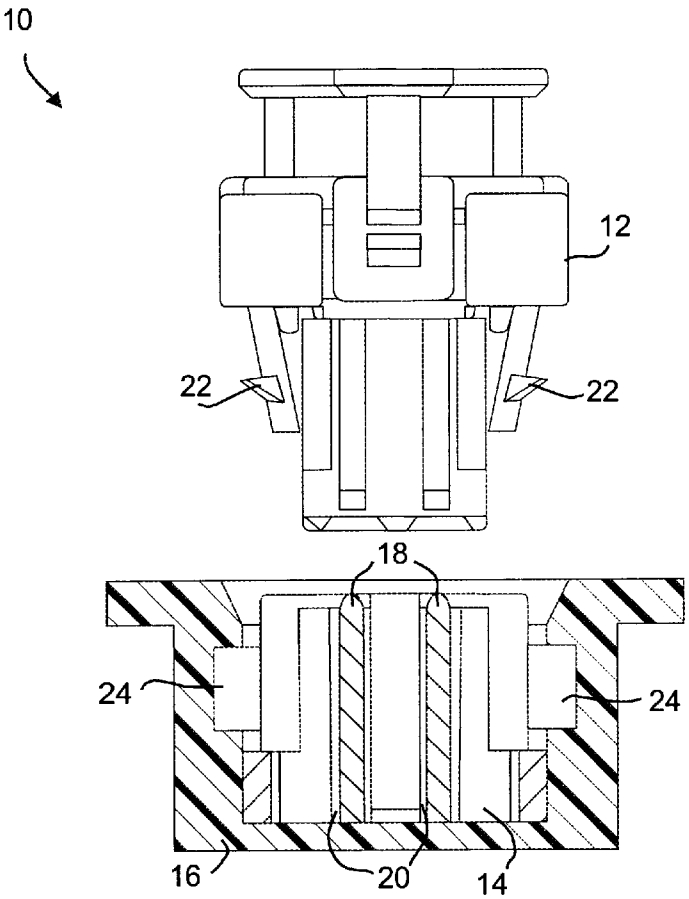
FIG. 1 (PRIOR ART)
FIG. 1 illustrates a perspective view of an embodiment of a prior art squib connector.

FIG. 1 illustrates an example of a prior art squib connector 10. The squib connector has a male squib connector 12 which is receivable within a female squib connector 14 which is located within a canister 16. Also located within the canister 16, and more specifically, within the female squib connector 14 are terminals 18 which provide an electrical connection with the male squib connector 12. A shorting bar 20 may also be present within the female squib connector 14 to provide an electrical connection with the male squib connector 12 when the male squib connector 12 is inserted within the female squib connector 14. The male squib connector 12 may be interlocked with the female squib connector 14, preferably, by positioning the ends 22 of the male squib connector 12 within edges 24 of the female squib connector 14. The ends 22 of the male squib connector 12 may provide resistance from removal from the female squib connector 14 once the ends 22 of the male squib connector 12 are positioned within the edges 24 of the female squib connector 14.

Once the male squib connector 12 is placed or positioned within close proximity to the terminals 18, an electrical connection may exist between the female squib connector 14 and the male squib connector 12. The male squib connector 12 need not be firmly secured within the female squib connector 14 for an electrical connection to exist between the male squib connector 12 and the female squib connector 14. In fact, when a user conducts a test at the end of the assembly line for a connection between the male squib connector 12 and a female squib connector 14, an electrically connected squib connector may pass this test. However, if the male squib connector 12 and the female squib connector 14 are not firmly interlocked, an airbag mechanism may not properly function.

Figure 2:
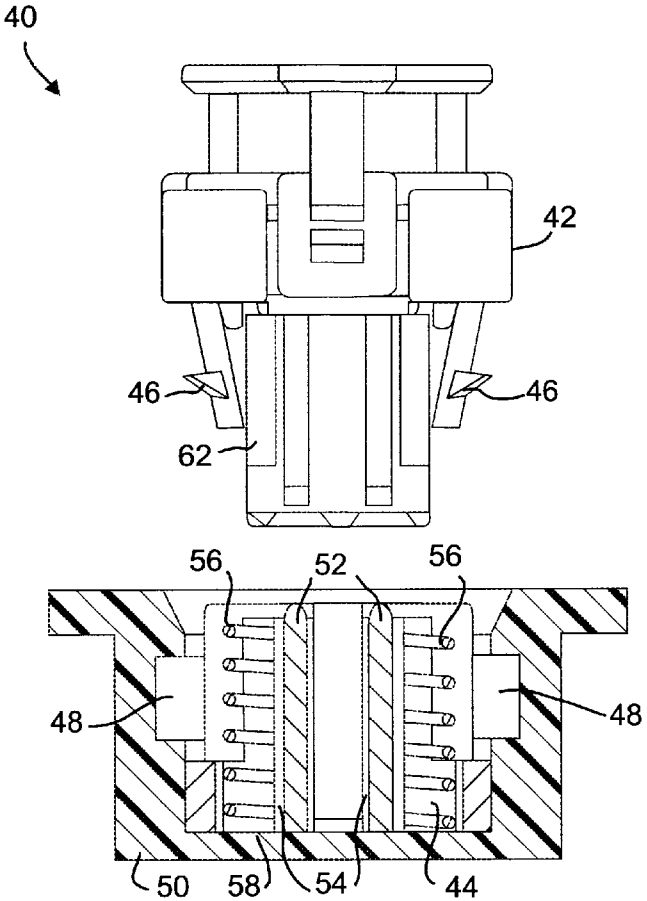
FIG. 2 illustrates a perspective view of an embodiment of the present invention prior to assembly.

FIG. 2 illustrates a squib connector 40, and a preferred embodiment of the present invention, prior to the positioning of the male squib connector 42 within a female squib connector 44. The female squib connector 44 is located within a canister 50. The male squib connector 42 and the female squib connector 44 may be constructed of any materials known to those skilled in the art. The male squib connector 42 has a contact terminal 62 and ends 46 which maybe securely interlocked within edges 48 of the female squib connector 44. The ends 46 may be shaped as illustrated in FIG. 2. Further, the ends 46 may have any shape known to those skilled in the art which is capable of interlocking within the edges 48 of the female squib connector. The female squib connector 44 also contains terminals 52 and a shorting bar 54 for a potential electrical connection with the male squib connector 42. In addition, the female squib connector 44 contains a disengaging member 56 located on the outside of the terminals 52. The disengaging member 56 may be, for example, a spring or other compressible or elastic member. In addition, the disengaging member 56 may be constructed of any material known to those skilled in the art. Further, the disengaging member 56 may be attached to a base 58 of the female squib connector 44.

Figure 3:
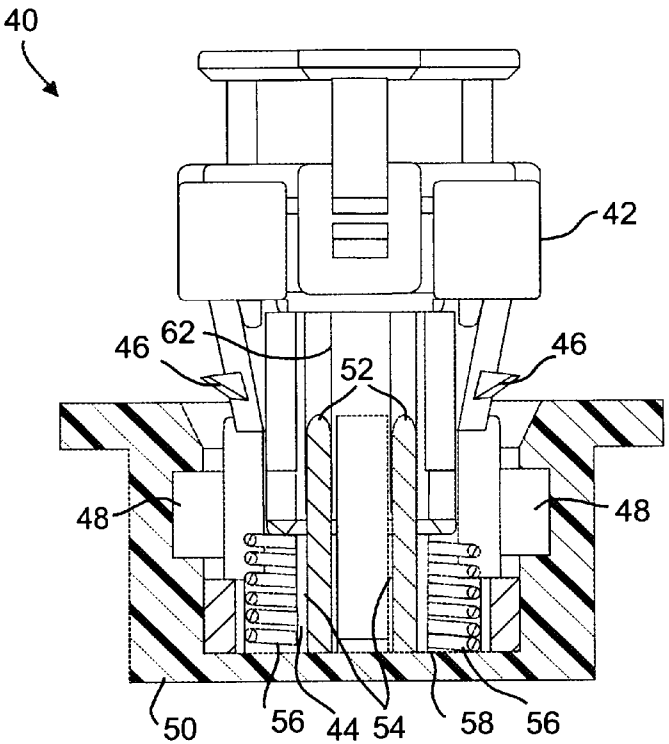
FIG. 3 illustrates a perspective view of an embodiment of the present invention prior to being in an interlocked state.

FIG. 3 illustrates the squib connector 40 where the male squib connector 42 has been positioned within the female squib connector 44. In the figure, the ends 46 of the male squib connector 42 are not positioned within the edges 48 of the female squib connector 44. Therefore, the male squib connector 42 is not securely interlocked with the female squib connector 44. The disengaging member 56 provides resistance against the male squib connector 42. The pressure exerted by the disengaging member 56 will prevent the male squib connector 42 and female squib connector 44 from obtaining an electrical connection until the male squib connector ends 46 are positioned securely within the edges 48 of the female squib connector 44. To this end, if the male squib connector 42 is not securely interlocked with the female squib connector 44, the disengaging member 56 will push the male squib connector 42 away from the female squib connector 44 such that no electrical connection can exist in the distance between the male squib connector 42 and the female squib connector 44.

Figure 4:
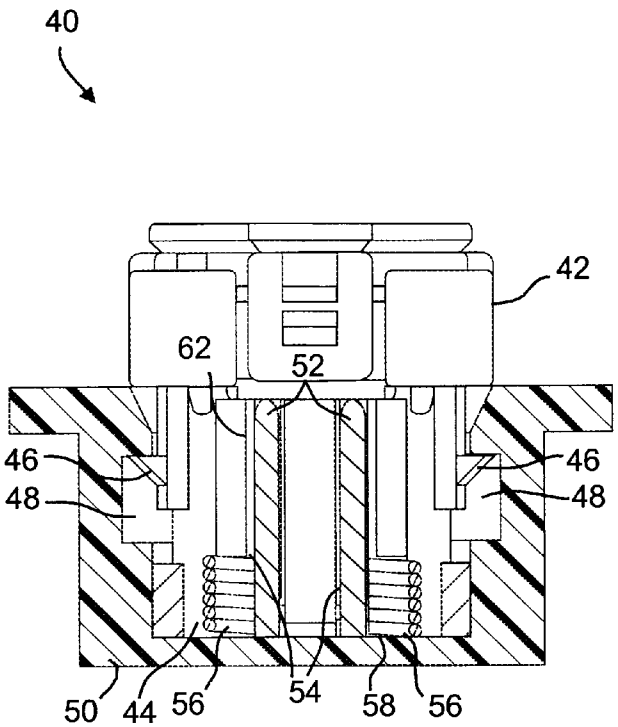
FIG. 4 illustrates a perspective view of an embodiment of the present invention in an interlocked state.

FIG. 4 illustrates the squib connector 40 in which the male squib connector 42 is securely interlocked with the female squib connector 44. The ends 46 of the male squib connector 42 are positioned within the edges 48 of the female squib connector 44 to provide resistance from removal of the male squib connector 42 from the female squib connector 44 and the contact 62 is electrically connected to contact 52 of the female squib connector 44. The force exerted by the disengaging member 56 against the male squib connector 42 cannot overcome the resistance by the male squib connector ends 46 against the edges 48 of the female squib connector 44. In this embodiment, secure electrical connection can exist between the male squib connector 42 and the female squib connector 44 because a disengaging member 56 cannot force the male squib connector 42 away from the female squib connector 44 at such a distance that an electrical connection is impossible. Thus, the male squib connector 42 is both interlocked and electrically connected within the female squib connector 44. The resulting squib connector 44 should then, theoretically, pass a test for proper connection at the end of the assembly line.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that all such changes and modifications be covered by the appended claims.

What is claimed is:

1. A squib connector comprising:

a male squib connector having an end and a contact;

a female squib connector having an aperture and at least one contact terminal mounted within the aperture the aperture sized to receive the contact and the end of the male squib connector; and a coil spring positioned within the aperture of the female squib connector providing for a male connector received within the aperture in:

a) an unlocked and unmated position where the coil spring provides a resistance directly against the end of the male squib connector in order to eject the end at least partially out of the aperture;

b) a locked and electrically mated position where the resistance is counteracted and the end engages an edge of the aperture to lock the male connector to the female squib connector; and wherein the coil spring resists the unlocked and the electrically mated position of the male squib connector within the female squib connector.

2. The squib connector of claim 1 wherein the coil spring is attached to a base of the female squib connector.

3. The squib connector of claim 1 wherein the male squib connector at the end has a set of ends and further wherein the female squib connector has a set of edges capable of receiving said set of ends.

4. The squib connector of claim 3 wherein the coil spring in said unlocked and unmated position provides resistance against the male squib connector away from the female squib connector that is counteracted when said set of ends are within said set of edges in said locked and mated position.

5. The connector of claim 1 wherein the unlocked and unmated position is provided where a portion of the end of a male squib connector is received within the aperture of a female squib connector.

6. The connector of claim 1 wherein the unlocked and unmated position is provided where an electrical connection exists between the contact of a male squib connector and the contact terminal of a female squib connector.

7. The squib connector of claim 1 wherein the locked and mated position is provided where the male squib connector and the female squib connector are firmly interlocked.

8. The squib connector of claim 1 wherein the locked and mated position is provided wherein electrical connection exists between the contact of the male squib connector and the contact terminal of the female squib connector.

9. The squib connector of claim 1 where in the unlocked and mated position is provided where the edge of the female squib connector aperture is not engaged with the end of the male squib.

10. The squib connector of claim 1 wherein the unlocked and mated position is provided where an electrical connection exists between the contact of the male squib connector and the contact terminal of the female squib connector.

11. A female squib connector and a male squib connector, the female squib connector having an aperture sized to receive at least a portion of a male squib connector, the female squib connector having a coil spring positioned within the aperture of the female squib connector for providing resistance against unlocked placement of the portion of the male squib connector within the female squib connector; and an end of the male squib connector interlocked within the female squib connector counteracting said resistance.

12. The female squib connector of claim 11 including a set of edges sized to receive a set of ends of the male squib connector, whereby the coil spring provides resistance against interlocked placement of the portion of the male squib connector within the female squib connector until the set of ends are positioned within the set of edges.

13. The female squib connector of claim 11 wherein the coil spring provides resistance against complete mating between the female squib connector and the male squib connector until edges of the female squib connector and ends of the male squib connector are interlocked.

14. A method for detecting an unmated connection in a circuit, the method comprising the steps of:

providing a male connector;

providing a female connector having an aperture sized to receive at least a portion of the male connector in an unlocked position;

positioning a coil spring within the aperture of the female connector for providing resistance against placement of the portion of the male connector within the female connector; and ejecting the unlocked male connector from the female connector via the resistance provided by the coil spring.

15. The method of claim 14 wherein the coil spring provides resistance against placement of the portion of the male connector completely within the female connector until the resistance is counteracted by the interlocking of the male connector and the female connector.

16. The method of claim 14 further comprising attaching the coil spring to a base of the female connector.

17. The method of claim 14 further comprising the resistance preventing an electrical connection between the female connector and the male connector that is counteracted when the female connector and male connector are interlocked.

18. An airbag mechanism including a squib connector having a female squib connector and a male squib connector the male squib connector achieved in an aperture of the female squib connector and further having a coil spring positioned within the aperture of the female squib connector for providing resistance against unlocked placement of a portion of the male squib connector within the female squib connector that is counteracted when the female squib connector and male squib connector are interlocked.

19. An airbag mechanism of claim 18 wherein the coil spring provides resistance against complete mating between the female squib connector and the male squib connector that is counteracted when the female squib connector and male squib connector are interlocked.

20. The airbag mechanism of claim 18 wherein the coil spring is attached to a base of the female squib connector.

21. A method of making a secure electrical connection between a male connector and a female connector comprising the steps of:

providing a male connector having a contact and an end;

inserting the end of the male connector within an aperture of a female connector in an unlocked position that is temporarily maintained by a coil spring mounted within the aperture providing a first force against the end of the male connector;

applying a second force, greater than the first force, against the coil spring via the male connector so that the end interlocks with an edge of the aperture and the male connector is locked within the aperture of the female connector and the contact is securely electrically connected to a contact terminal mounted within the female connector.

22. The method of claim 21 further wherein upon application of the second force the end of the male connector slides further into the aperture and springs outwardly to engage the edge provided by the female connector.

23. The method of claim 22 wherein at least a pair of ends are provided by the male connector and at least a pair of edges are provided by the female connector corresponding to the ends.

24. A method of preventing a male connector from having an unlocked mated position comprising the steps of:

providing a male connector having a contact and an end;

providing a female connector having an aperture to receive the end of the male connector and a contact terminal and a coil spring mounted in the aperture;

inserting the end into the aperture to an unlocked unmated position; and applying a resistance force against the end of the male connector via the coil spring so that upon applying a force against the male connector, that is less than the resistance force the male connector is ejected from the aperture.

* * * * *